United States Patent [19]

Walton et al.

[11] Patent Number: 5,012,157

[45] **Date of Patent: * Apr. 30, 1991**

[54] LONG-LIFE LUMINAIRES

[76] Inventors: John F. Walton, 6853 Strata St., McLean, Va. 22101; Al R. Roshdieh, 688 College Pkwy., Rockville, Md. 20850

[ * ] Notice: The portion of the term of this patent subsequent to Nov. 1, 2005 has been disclaimed.

[21] Appl. No.: 259,320

[22] Filed: Oct. 18, 1988

Related U.S. Application Data

[63] Continuation-in-part of Ser. No. 37,229, Apr. 10, 1987, abandoned.

[51] Int. Cl.[5] ..... H01J 7/44; H05B 39/10; H05B 41/46

[52] U.S. Cl. ..... 315/66; 315/71; 315/93; 315/122; 315/179; 315/185 R; 315/192

[58] Field of Search ..... 315/66, 71, 93, 122, 315/179, 185 R, 185 S, 192

[56] References Cited

U.S. PATENT DOCUMENTS

| | | | |
|---|---|---|---|
| 1,839,479 | 1/1932 | Hartman | 313/1 |
| 2,042,963 | 6/1936 | Rentschler et al. | 220/221 R |
| 2,095,306 | 10/1937 | Austin | 315/192 X |
| 2,297,258 | 9/1942 | Spanner | 315/93 X |
| 3,912,966 | 10/1975 | Harnden, Jr. | 315/122 X |
| 3,930,183 | 12/1975 | Harnden, Jr. | 315/71 |
| 4,143,411 | 3/1979 | Roberts | 362/145 |
| 4,161,021 | 7/1979 | George, Jr. | 362/238 |
| 4,173,035 | 10/1979 | Hoyt | 40/541 |
| 4,185,219 | 1/1980 | Kamio | 313/273 |
| 4,204,273 | 5/1980 | Goldberg | 362/219 |
| 4,272,698 | 6/1981 | Oyama et al. | 319/272 |
| 4,285,032 | 8/1981 | Honda et al. | 313/316 |
| 4,355,348 | 10/1982 | Williams | 362/86 |
| 4,410,835 | 10/1983 | Zabroski | 307/66 |
| 4,425,601 | 1/1984 | Donahue | 200/86 R |
| 4,425,605 | 1/1984 | Cheng | 315/185 S |
| 4,461,974 | 7/1984 | Chiu | 315/65 |
| 4,473,776 | 9/1984 | Peters | 315/71 X |
| 4,521,839 | 6/1985 | Cook et al. | 362/227 |
| 4,587,597 | 5/1986 | Meyers | 40/553 |
| 4,596,944 | 6/1986 | Gorstein | 313/1 |
| 4,597,035 | 6/1986 | Lettenmeyer | 362/219 |
| 4,665,470 | 5/1987 | George, Jr. | 362/236 |
| 4,748,545 | 5/1988 | Schmitt | 362/219 |
| 4,782,429 | 11/1988 | Walton et al. | 362/20 |

FOREIGN PATENT DOCUMENTS 2605888 8/1976 Fed. Rep. of Germany .

*Primary Examiner*—Eugene R. LaRoche
*Assistant Examiner*—Michael B. Shingleton
*Attorney, Agent, or Firm*—Howard L. Rose

[57] ABSTRACT

There is provided a luminaire primarily for use with exit signs and other emergency-type lighting comprising a series string of low-voltage, extremely long-life bulbs positioned within an enclosure for protection and electrically connected to a standard base whereby luminaires having lives of 10 to 30 years may replace standard bulbs without the requirement of retrofitting.

3 Claims, 1 Drawing Sheet

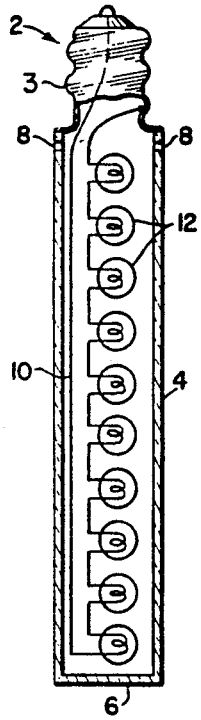
Fig.1
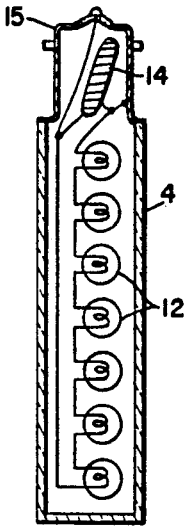
Fig.2
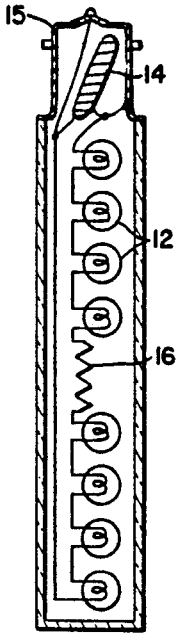
Fig.3
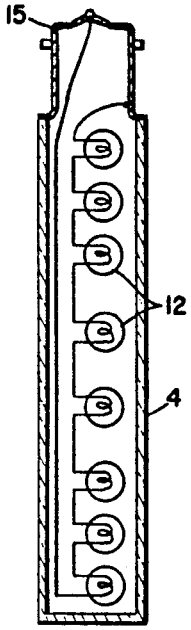
Fig.4
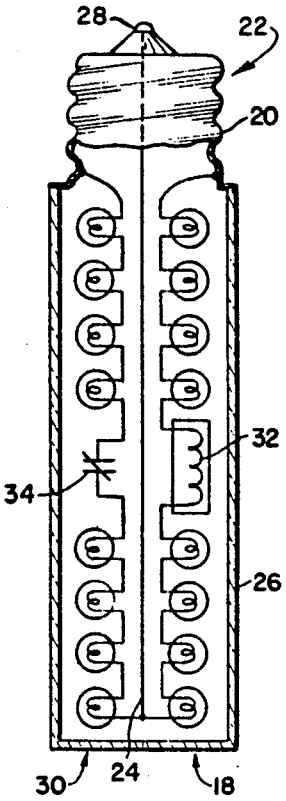
Fig.6
Fig.5
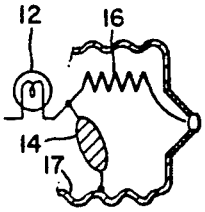
Fig.7
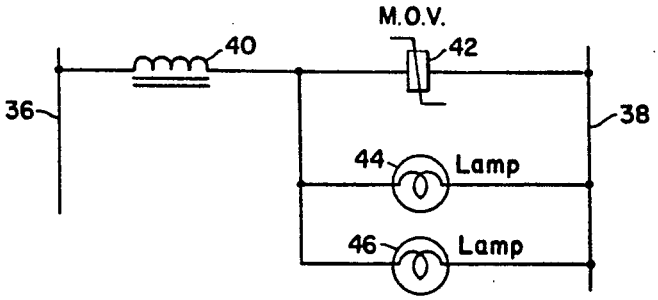

LONG-LIFE LUMINAIRES

RELATED APPLICATIONS

This is a Continuation-in-part application of Ser. No. 037,229 filed Apr. 10, 1987.

BACKGROUND OF THE INVENTION

The present invention relates to electric lights and, more particularly, to extremely long-life luminaires for illuminating exit signs, and related emergency signs and the like, which luminaires do not require retrofitting of the fixtures with which they are used.

The bulbs currently available for emergency light fixtures such as exit signs have, considering their intended use, short lives of the order of 300 to 2000 hours with, as would be expected, shorter lives for individual units within this group. The cost of constantly checking, maintaining, and replacing bulbs is estimated to be at least $100 per year per fixture for outside maintenance and $60 per year for in-house maintenance.

A related and more significant problem relating to these fixtures is the danger to humans if exit signs and the like are not illuminated due to burned-out bulbs and the exits in a burning or damaged building cannot be found. Deaths resulting from such occurrences are possible and in addition to human suffering there is the ever-present threat of expensive and protracted litigation.

There is a significant need for bulbs with extended life, say, on the average, five- to ten-year lives with a guaranteed three- to five-year life. The savings in lives, injuries, maintenance costs, damages, and lawsuits would be highly significant with the availability of such a bulb, particularly one that does not require retrofitting of existing fixtures. It is believed that this latter feature, although not essential to a successful product, is in fact significant.

SUMMARY OF THE INVENTION

The present invention provides one of several different standard lightbulb bases, a hollow plastic or glass tube, clear or appropriately frosted, and a series string of small, fifty thousand-hour, 14-volt bulbs. If operated at 14 volts, these bulbs have a typical life of, as indicated, fifty thousand hours, but if operated at 12 volts, 10 bulbs in series, the expected life is about 11 years. The life of individual bulbs may be less than the calculated life, and thus the average life of the string will statistically be less than 11 years, but a guaranteed life of 5 years is quite plausible.

If a longer guaranteed life is desired, then two strings of lights may be included in a single shell with or without a switch-over from one string to a second string upon failure of the one string.

To lessen the danger of shortened life due to large voltage surges, a varistor may be connected across the two electrical ends of the string. Also, one of the bulbs may be replaced by a long-life current-limiting resistor or inductor to further extend the guaranteed life of the individual bulbs.

The resistor serves to reduce the current surge when the lamp is first turned on. At such time the resistance of the bulbs is quite low while the resistance of the resistor remains relatively constant and thus materially increase the resistance of the device at turn on relative to what it would be if only bulbs were present. If the resistor is used in a device equipped with a varistor, the resistor is located between the source and where the varistor is connected to the string. Thus a series circuit of the resistor and varistor is connected across the source with the varistor in parallel with the string of bulbs. In such a case if the surge is large enough to burn out one of the bulbs, the resistor protects the varistor from the full surge and in most instances will prevent its burn-out.

A series string of 8 to 10 bulbs of the type contemplated for use herein provides as much and usually more light than the bulbs currently employed for emergency sign lighting. By using standard bases, the lights of the present invention may be screwed or plugged into standard bases in a single replacement operation. No retrofitting is required.

BRIEF DESCRIPTION OF THE DRAWINGS

FIG. 1 is a side view of one embodiment of the present invention.

FIG. 2 is a side view of a second embodiment of the present invention.

FIG. 3 is a side view of a third embodiment of the present invention.

FIG. 4 is a side view of a fourth embodiment of the present invention.

FIG. 5 illustrates a preferred embodiment employing a resistor and varistor.

FIG. 6 is a side view of a fifth embodiment of the present invention.

FIG. 7 is a circuit diagram of the input supply to the luminaire of the present invention.

DETAILED DESCRIPTION OF THE INVENTION

Referring now specifically to FIG. 1 of the accompanying drawings, there is illustrated one embodiment of the luminaires of the present invention.

A standard lamp base 2 has mounted thereon a hollow, elongated glass or plastic tube 4, which may be clear or frosted. The tube may be colored or colorless, have a closed end 6 and air holes 8 adjacent to the base 2 or elsewhere, as appropriate. A string of ten small, long-lived lightbulbs 12, preferably arrayed in a generally straight line, is located interiorly of the tube 4 and extends between a center conductive support 10 and the outer shell 3 of the base 2.

In this case, each of the bulbs, which may be a Chicago Miniature Lamp Works #CM-2182 or the equivalent, have approximately a 12-volt drop across them.

Referring to FIG. 2 of the accompanying drawings, there is illustrated the luminaire of FIG. 1 with the addition of a varistor 14 connected across the two ends of the string of bulbs. The purpose of this element is to isolate the filaments from high-voltage surges. It will be noted that a standard bayonet base 15 is employed.

Reference is now made to FIG. 3, which illustrates a luminaire that is the same as illustrated in FIG. 2, with the addition of a long-life resistor 16 in replacement of one of the lamps. This resistor is employed to reduce the effects of surge currents upon lamp turn-on. If the resistor has a resistance equal to that of the average value of one of the lamps in incandescent condition, and there are nine lamps in series with the resistor 16, the turn-on in-rush of surge current is reduced to $\frac{1}{4}$ to $\frac{1}{3}$ of its value in the absence of the resistor 16. The quality of the current limiting is such that moderately high voltages and momentary surges are handled without degradation of the filaments of the bulbs. If the resistor 16 is placed in the approximate middle of the string, the light is decentralized, which is useful in providing more uniform lighting. With standard luminaires in exit signs or luminaires of the present invention as set forth in the prior figures, the light appears to be concentrated in the center.

Improved light distribution may also be achieved by the unequal distribution of the individual bulbs as illustrated in FIG. 4. The bulbs are more widely spaced in the middle, thus reducing the appearance of light concentration in the middle.

Referring specifically to FIG. 5, the position of the resistor is changed. The resistor 16 is now located between the connection of one end of the varistor 14 and central lead 17 of the bulb. This resistor now serves two functions, to prevent start up surges and to protect the varistor and the lamps from a voltage surge that would otherwise burn out one or more bulbs. If the resistor is located as in FIG. 3, and a bulb is burned out by a surge, the varistor takes the full surge. The arrangement of FIG. 5 divides in some predetermined ratio the voltage between the resistor and the varistor.

Reference is now made to FIG. 6 of the accompanying drawings, wherein is illustrated a luminaire having two serial strings of bulbs in parallel and a relay for switching over to a second of the strings when a first string fails.

Specifically, a first string of bulbs 18 is connected between the outer shell 20 of the base 22 of the lamp, and the end of a center conductive support 24 remote from the base. The other end of the support 24 extends into contact with a center contact 28 of the base 22. Again, the string is located interiorly of a preferably closed end outer glass or plastic shell 26. The shell 26 may be provided with air holes, as appropriate.

A second string of bulbs 30 also extends between the remote end of the center conductor 24 and the contact 28. The string 18 has a relay coil 32 connected in series with the string, preferably in the center thereof, and a normally closed contact 34 of the relay coil 32 connected in series with the string 30. The normally closed contact 34 is held open as long as the string 18 is intact; that is, conductive. Upon failure of a bulb of the string 18 or the relay coil, the contact 34 closes and the string 30 is energized.

Such an arrangement greatly extends, essentially doubles, the expected life of the unit and makes it much less likely to have premature failures. Premature failures can occur, as with any luminaire. The possibility of such a failure is greatly reduced in this situation. In still another arrangement two strings of bulbs are in parallel all of the time, providing equally good protection against premature failure as the arrangement of FIG. 6 but only extending life to a limited extent.

The relay employed may be either an AC relay or a DC type with a diode connected across the coil or an AC or DC type in a bridge rectifier with or without a capacitor connected across the coil.

It should be noted that the life of the bulbs and of the varistor, if used, can be further extended by using a surge-limiting coil in the line to the luminaire. Such an arrangement is illustrated in the circuit diagram of FIG. 7. Specifically, the AC lines 36 and 38 have connected across them an inductor 40 and varistor 42 in series. The fixtures in which these luminaires are used usually have two bulbs, which in FIG. 7 are represented by bulbs 44 and 46, which, in the present invention, are each replaced by any one of the luminaires of the present invention. The inductor 40 is chosen to have low reactance at 60 Hz providing low losses in normal operation compared to a resistor. High transients, however, are highly attenuated by the inductor protecting both the bulbs and the varistor from large over voltages.

In alternative forms the reactor can be replaced by a resistor, and the varistor can be replaced by a capacitor. Both of these forms, however, are not as effective as that described relative to FIG. 7.

The present invention thus provides a luminaire that may be inserted into a standard light fixture and has a life that is measured in numbers of years rather than in months. In use with illuminated exit signs and in emergency lighting situations, the cost of the bulbs of the present invention represents only a fraction of the annual cost of servicing and maintaining emergency signs.

It should be noted that the strings of lights are not required to be straight lines, but it has been found that considering costs of manufacture and uniformity of light such an arrangement is preferred.

Other improvements, modifications, and embodiments will become apparent to one of ordinary skill in the art upon review of this disclosure. Such improvements, modifications, and embodiments are considered to be within the scope of this invention as defined by the following claims:

We claim:

1. A long-life luminaire for signs powered by power company standard voltages for use in emergency lighting and signs comprising:

a string of individual long-life, low-voltage light bulbs electrically connected in series;

means for connecting said string across a source of said power company voltages;

said light bulbs having a life of five years at 14 volts and ten years at 12 volts, at least one varistor electrically connected in parallel with the entire said string of light bulbs;

said string of light bulbs having two ends, the spacing between the light bulbs in the center of said string being greater than towards the ends of said string of light bulbs.

2. A long-life luminaire for signs powered by power company standard voltages for use in emergencies, comprising:

a first string of individual long-life, low-voltage light bulbs having electrical ends electrically connected in series;

means for connecting said string across a source of electrical energy;

a resistor connected in series with said string of bulbs;

said resistor having a resistance approximately equal to that of one of said bulbs when at incandescent temperature; and at least one varistor connected across said electrical ends of the entire string of the long-life, low-voltage lamps only.

3. The long-life luminaire of claim 2 further comprising said varistor and resistor connected in series across said power company standard voltages with said varistor in parallel with said string of light bulbs.

* * * * *